United States Patent [19]

Pahl

[11] 4,362,479

[45] Dec. 7, 1982

[54] ROTARY FLUID PRESSURE DEVICE AND LUBRICATION CIRCUIT THEREFOR

[75] Inventor: James H. Pahl, Wayzata, Minn.

[73] Assignee: Eaton Corporation, Cleveland, Ohio

[21] Appl. No.: 247,463

[22] Filed: Mar. 25, 1981

[51] Int. Cl.[3] ..... F01C 1/02

[52] U.S. Cl. ..... 418/61 B; 418/87; 418/102

[58] Field of Search ..... 418/61 B, 102, 87

[56] References Cited

U.S. PATENT DOCUMENTS

| | | | |
|---|---|---|---|
| Re. 28,441 | 6/1975 | Easton | 418/270 |
| 3,107,493 | 10/1963 | Huber | 60/97 |
| 3,286,645 | 11/1966 | Albers | 418/61 B |
| 3,532,447 | 10/1970 | Charlson | 418/61 B |
| 3,606,598 | 9/1971 | Albers | 418/61 B |
| 4,159,723 | 7/1979 | Baatrup et al. | 418/61 B |
| 4,171,938 | 10/1979 | Pahl | 418/102 |
| 4,199,305 | 4/1980 | Pareja | 418/102 |

*Primary Examiner*—P. S. Lall

*Attorney, Agent, or Firm*—C. H. Grace; F. M. Sajovec

[57] ABSTRACT

A rotary fluid pressure device is disclosed of the type utilizing a gerotor gear set (13) and an output shaft assembly (45) including a spool valve (49). The device includes a housing (11) defining inlet and outlet ports (21 and 23). The spool valve and housing cooperate to define a lubrication fluid chamber (59). Torque is transmitted from the gerotor set to the output shaft by a dogbone shaft (61) having a rearward spline connection (65, 69) to the gerotor, and a forward spline connection (63, 67) to the output shaft. The spool valve defines a pair of annular grooves (71, 73) in communication with the ports and a pair of check valve assemblies (91, 93) to permit flow of lubrication fluid from the lubrication chamber into whichever of the annular grooves is in communication with the outlet port. The resulting lubrication circuit insures a good flow of lubrication through both of the spline connections, in either direction of operation of the device, and further insures that contamination particles are carried from the spline connections to the outlet port without having to pass through severe flow restrictions which can trap such particles.

8 Claims, 10 Drawing Figures

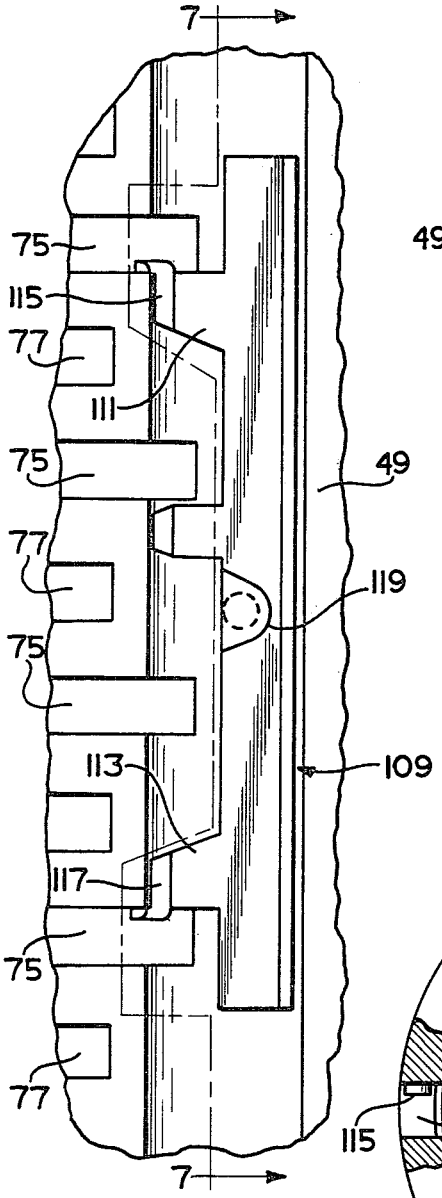
FIG. 6
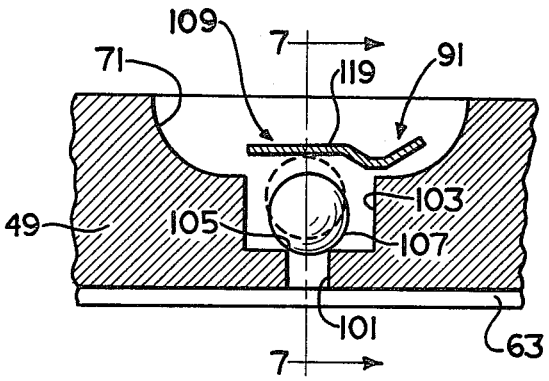
FIG. 5
FIG. 7
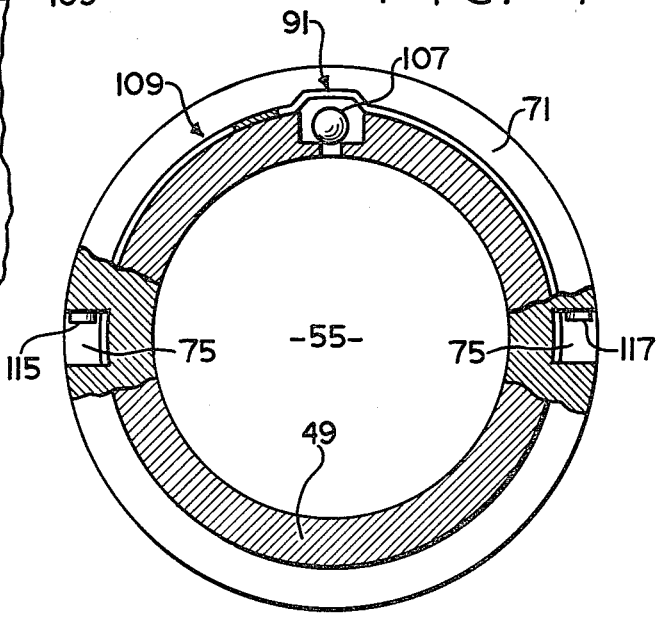

ROTARY FLUID PRESSURE DEVICE AND LUBRICATION CIRCUIT THEREFOR

BACKGROUND OF THE DISCLOSURE

The present invention relates to rotary fluid pressure devices, and more particularly, to lubrication circuits for such devices.

Although it should become apparent from the subsequent description of the invention that it may be useful with many types of rotary fluid pressure devices, including both pumps and motors, it is especially advantageous when used in a fluid motor and will be described in connection therewith.

Also, although the invention may be used with devices having various types of internal gear sets, the invention is especially adapted for use in a device including a gerotor gear set, and will described in connection therewith.

Fluid motors of the type utilizing a gerotor gear set to convert fluid pressure into a rotary output have become popular and are especially suited for low speed, high torque applications. In one of the most common designs of such motors, the housing defines inlet and outlet ports and a cylindrical valve bore, and the motor includes a hollow, cylindrical spool valve which is integral with the output shaft. The well known commutating valve action necessary to communicate pressurized fluid to the expanding volume chambers of the gerotor set and communicate exhaust fluid from the contracting volume chambers occurs at the interface of the housing bore and valve spool.

Thus, in a motor of the type described, there are three different pressure "zones":

1. the high pressure zone extending from the inlet port to the expanding volume chambers;
2. the low pressure zone extending from the contracting volume chambers to the outlet port; and
3. the case drain zone (lubrication fluid chamber).

The lubrication fluid chamber is typically the central region of the motor defined by the hollow spool valve, the externally toothed gerotor star, and the housing. A major portion of the fluid entering this chamber is leakage fluid from the pressurized gerotor volume chambers. In addition, a certain amount of leakage fluid flows through the cylindrical clearance between the spool valve and housing bore and enters the lubrication chamber at either the forward end, or the rearward end, depending upon the direction of operation of the motor.

In most of the commercially available motors of the type described above, output torque is transmitted from the externally toothed member of the gerotor set to the output shaft assembly by means of a dogbone shaft which is in splined engagement with both the externally toothed gerotor member and the output shaft. One of the primary factors limiting the torque output capability of such motors is the strength of these two spline connections. It has long been recognized by those skilled in the art that the strength of these spline connections may be increased by improving lubrication flow through the spline connections. Therefore, the primary function of leakage fluid which enters the lubrication chamber is to flow through the spline connections to prevent metal to metal contact of the splines, and to remove heat and contamination particles.

In one of the typical prior art devices, lubrication fluid was forced to flow through a very restricted flow path, even after passing through the spline connections, with the rsult that contamination particles could become trapped between relatively movable portions of the motor, rather than being flushed out of the motor.

In another prior art design, the motor was provided with an external case drain connection to permit relatively unrestricted flow of lubrication fluid. In one direction of motor operation, the result would be good lubricant flow through both splines connections, but in the opposite motor direction, the result would be lubricant flow through one of the spline connections (typically the spline connection with the gerotor), but negligible lubricant flow through the other spline connection.

SUMMARY OF THE INVENTION

Accordingly, it is an object of the present invention to provide a lubrication circuit for a fluid motor of the type described which results in good lubricant flow through both spline connections in either direction of motor operation.

It is another object of the present invention to provide a lubrication circuit which is arranged such that lubricant flow removes contamination particles from the spline connections, then flows to the outlet port through a relatively unrestricted flow path, to insure removal of such particles from the motor.

The above and other objects of the present invention are accomplished by the provision of an improved lubrication circuit for rotary fluid pressure devices of the type described. The improved lubrication circuit includes first check valve means disposed to permit fluid communication from the lubrication fluid chamber to the first annular groove when the second fluid port receives pressurized fluid. The lubrication fluid from the gear set flows through the rearward spline connection, combines with lubrication fluid from the second annular groove, and flows through the forward spline connection to the first check valve means. The lubrication circuit further includes second check valve means disposed to permit fluid communication from the lubrication chamber to the second annular groove when the first fluid port receives pressurized fluid. Lubrication fluid from the gear set flows through the rearward connection means to the second check valve means while lubrication fluid from the first annular groove flows through the forward spline connection to the second check valve means.

In accordance with a more limited aspect of the present invention, each of the first and second check valve means includes a check valve member and means disposed radially outwardly of the check valve member to limit radially outward movement thereof. Preferably, the limiting means comprises a clip member adapted to be disposed within the annular groove and to grippingly engage the valve spool around a major portion of the circumference thereof. The clip member is configured to limit radial movement of the check valve member while permitting relatively unrestricted flow of lubrication fluid past the check valve member.

BRIEF DESCRIPTION OF THE DRAWINGS

FIG. 5 is an enlarged, fragmentary view, similar to FIG. 1, illustrating one of the check valve assemblies utilized in the present invention.

FIG. 6 is an enlarged, layout view of the clip member utilized in a preferred embodiment of the check valve assembly, superimposed on a layout view of the outer surface of the spool valve.

FIG. 7 is a transverse cross section taken generally on line 7—7 of FIG. 5, but on a smaller scale, and also taken on line 7—7 of FIG. 6, and on the same scale as FIG. 6.

DESCRIPTION OF THE PREFERRED EMBODIMENTS

Figure 1:
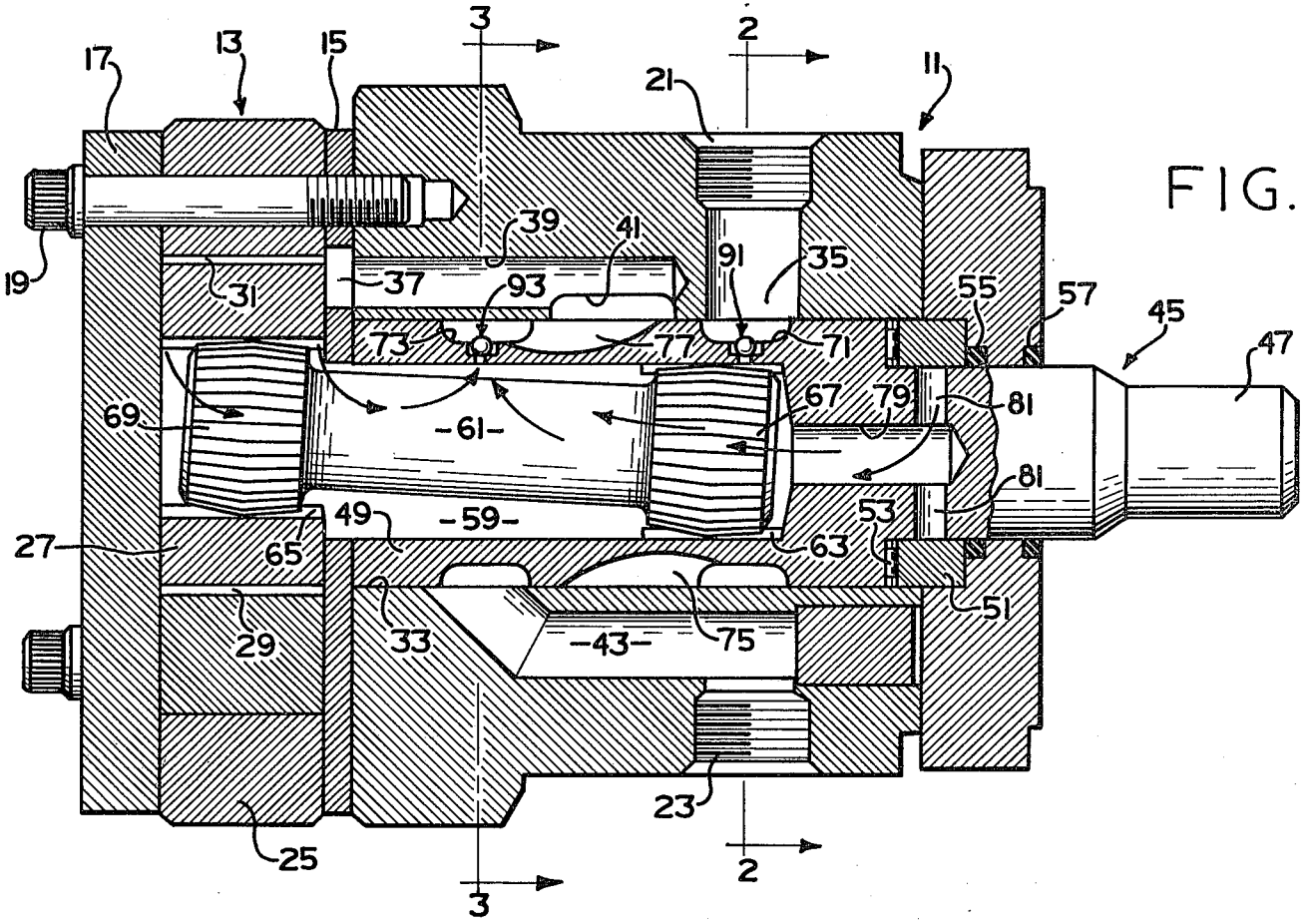
FIG. 1 is an axial cross section of a fluid motor utilizing the present invention, taken generally along line 1—1 of FIG. 2, with the output shaft rotating clockwise when viewed from the right.

Referring now to the drawings, which are not intended to limit the invention, FIG. 1 is an axial cross section of a fluid motor of the type to which the present invention may be applied, and which is described in greater detail in U.S. Pat. No. 3,606,598, assigned to the assignee of the present invention. The fluid motor of FIG. 1 is generally cylindrical and comprises several distinct sections. The motor comprises a valve housing section 11, a displacement mechanism 13 which, in the subject embodiment, is a roller gerotor gear set, and a port plate 15 disposed between the housing section 11 and gear set 13. Disposed adjacent the gear set 13 is an end cap 17, and the housing section 11, port plate 15, gear set 13 and end cap 17 are held together in fluid sealing engagement by a plurality of bolts 19.

The valve housing section 11 includes a fluid port 21 and a fluid port 23. The gerotor gear set 13 includes an internally-toothed member 25 (stator), through which the bolts 19 pass, and an externally-toothed member 27 (rotor). The teeth of the stator 25 and rotor 27 enterengage to define a plurality of expanding volume chambers 29, and a plurality of contracting volume chambers 31, as is well known in the art.

The valve housing section 11 defines a spool bore 33 and a fluid passage 35 which provides continuous fluid communication between the bore 33 and the fluid port 21. In fluid communication with each of the volume chambers 29 and 31 is a port 37 defined by the port plate 15, and in fluid communication with each of the ports 37 is an axial passage 39 (see also FIG. 3), drilled in the valve housing section 11. Each of the axial passages 39 communicates with the spool bore 33 through a slot 41 which, typically, is milled during the machining of the housing section 11. The valve housing section 11 also defines a fluid passage 43 which provides communication between the fluid port 23 and the spool bore 33.

Disposed within the spool bore 33 is an output shaft assembly, generally designated 45, including a shaft portion 47 and a spool valve portion 49. Seated between the housing section 11 and a forward surface (shoulder) of the spool valve 49 is a thrust race 51 and a thrust bearing 53. Disposed between the housing section 11 and the shaft portion 47 is a pressure seal 55 and a dust seal 57.

The spool valve portion 49, the port plate 15, and the rotor 27 cooperate to define a lubrication fluid chamber 59, within which is disposed a main drive shaft 61, commonly referred to as a "dogbone" shaft. The output shaft assembly 45 defines a set of straight, internal splines 63, and the rotor 27 defines a set of straight, internal splines 65. The drive shaft 61 includes a set of external, crowned splines 67 in engagement with the internal splines 63, and a set of external, crowned splines 69 in engagement with the internal splines 65.

The spool valve portion 49 defines an annular groove 71 in continuous fluid communication with the fluid port 21 through the fluid passage 35. Similarly, the spool valve 49 defines an annular groove 73 which is in continuous fluid communication with the fluid port 23, through the passage 43. The spool valve 49 further defines a plurality of axial feed slots 75 and a plurality of axial feed slots 77. The slots 75 provide fluid communication between the annular groove 71 and the slots 41 disposed on one side of the line of eccentricity of the gerotor gear set 13, while the slots 77 provide fluid communication between the annular groove 73 and the slots 41 which are on the other side of the line of eccentricity. The resulting commutating valve action between the slots 75 and 77 and the slots 41 is well known in the art and will not be described further herein.

The output shaft assembly 45 defines an axially-oriented bore 79 which is in fluid communication, at its left end in FIG. 1, with the lubrication fluid chamber 59, and in fluid communication, at its right end, with the bearings and seals by means of a pair of radial bores 81. The primary function of the bores 79 and 81 is to define a portion of the lubrication circuit, which will be described in greater detail subsequently.

Figure 2:
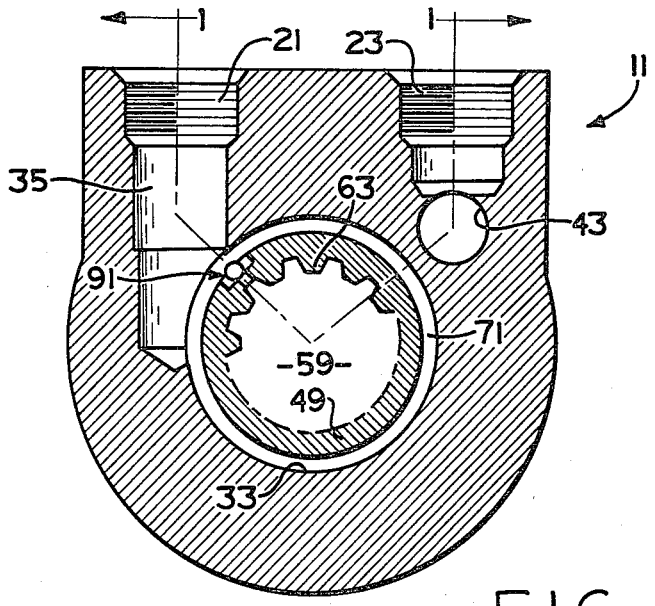
FIGS. 2 and 3 are transverse sections taken on lines 2—2 and 3—3, respectively, of FIG. 1, and on the same scale.
Figure 3:
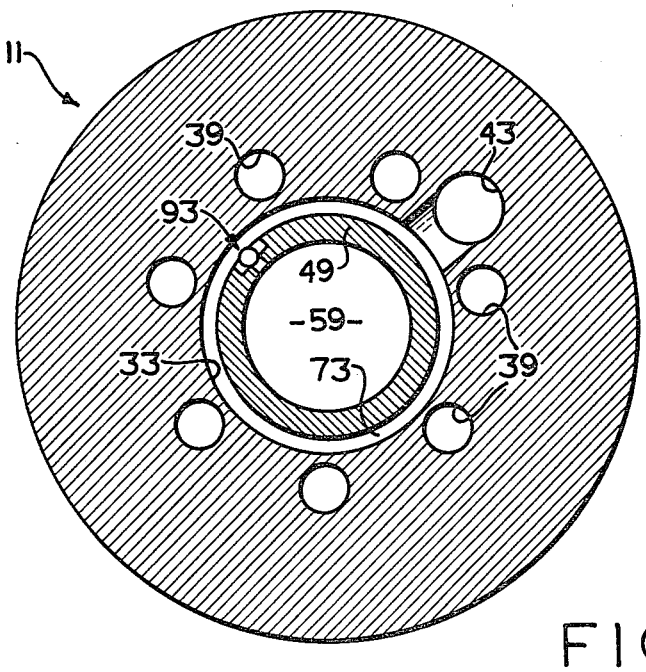

Referring still primarily to FIGS. 1-3, the spool valve 49 includes a pair of check valve assemblies, generally designated 91 and 93, which are not illustrated in detail in FIGS. 1-3. The check valve assembly 91 permits fluid communication from the lubrication fluid chamber 59 to the annular groove 71, and the check valve assembly 93 permits fluid communication from the lubrication fluid chamber 59 to to the annular groove 73.

OPERATION

The operation of fluid motors of the type illustrated in FIGS. 1-3 is well known in the art and will be described only briefly herein. When the fluid port 21 is connected to a source of pressurized fluid, pressurized fluid fills the passage 35, the annular groove 71, and each of the axial feed slots 75. Pressurized fluid flows through the slots 41 which are in instantaneous communication with the slots 75, then through the associated axial passages 39 and ports 37 into the expanding volume chambers 29. This flow of pressurized fluid results in movement of the rotor 27 which includes orbital movement in the counterclockwise direction (as viewed from the right in FIG. 1), and rotational movement in the clockwise direction. The clockwise rotation of the rotor 27 is transmitted by the drive shaft 61 into rotational movement of the output shaft assembly 45, also in the clockwise direction.

At the same time, low pressure fluid is being exhausted from the contracting volume chambers 31 and flows through the associated ports 37, the axial passages 39, and the slots 41. This exhaust fluid is communicated to the feed slots 77 which are in instantaneous communication with those particular slots 41. This low pressure exhaust fluid flows from the feed slots 77 into the annular groove 73, then through the fluid passage 43 to the fluid port 23, and then to the system reservoir.

LUBRICATION CIRCUIT

A major portion of the pressurized fluid entering the fluid port 21 follows the flow path described above, which may be referred to as the operating flow path or main flow path. However, as is well known to those skilled in the art, a certain portion of the pressurized fluid entering the motor deviates from the main flow path as leakage fluid which is then used to lubricate various parts of the motor, especially the spline connections. As was described in the background of the specification, among the primary functions of lubricant flow in a motor of the type disclosed is to carry away contamination particles and heat.

With the fluid port 21 receiving pressurized fluid, there are two primary sources of leakage (lubrication) fluid. Some pressurized fluid leaks from the groove 71 and flows through the radial clearance between the spool bore 33 and the spool valve 49, to the right in FIG. 1. This fluid first lubricates the thrust bearing 53, then flows into the radial bores 81, and through the axial bore 79 into the lubrication fluid chamber 59. The other primary source of lubrication fluid, regardless of the direction of operation of the motor, is fluid which leaks between the end faces of the rotor 27 and the adjacent surfaces of the end cap 17 and port plate 15. As is well known in the art, the axial length of the stator 25 is slightly greater than that of the rotor 27 to permit movement of the rotor 27 without binding, and also to permit the necessary lubrication flow. This lubrication fluid flows radially inwardly into the chamber 59, then flows to the right in FIG. 1.

With the fluid port 21 pressurized, the check valve assembly 91 is maintained in a closed position, but because the fluid port 23 is connected to the reservoir, the check valve assembly 93 is able to open, permitting relatively unrestricted flow of lubrication fluid from the chamber 59 into the annular groove 73. As a result of the location of the check valve assembly 93, lubrication fluid entering the chamber 59 from the bore 79 flows through the splines 63 and 67, then through the check valve assembly 93 and out to the reservoir without having to pass through any restrictions or clearances which are sufficiently small to trap contamination particles removed from the splines by the lubrication flow. Similarly, lubrication fluid which enters the chamber 59 from the clearance between rotor 27 and end cap 17 flows through the splines 65 and 69, then through the check valve assembly 93 to the reservoir, without passing through small restrictions, or clearances which can trap particles.

FIG. 4—COUNTERCLOCKWISE

Figure 4:
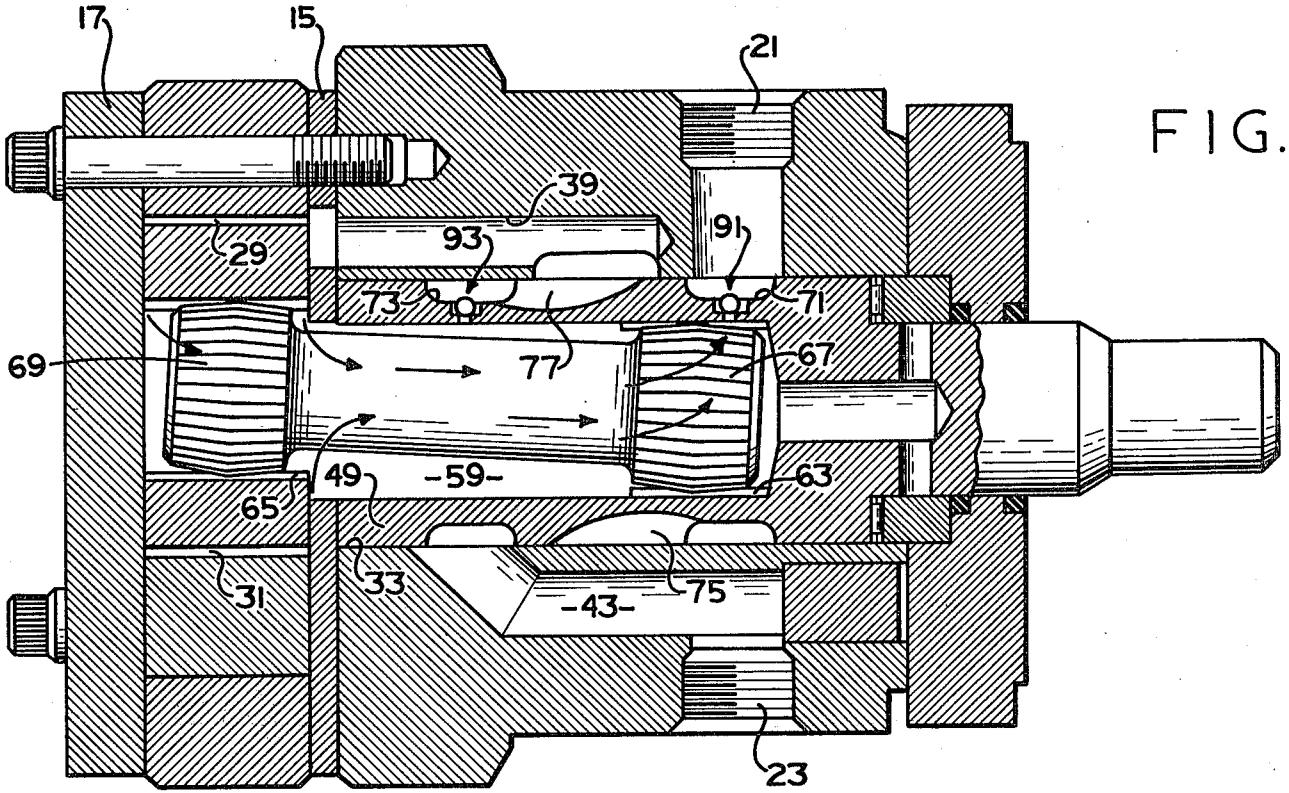
FIG. 4 is an axial cross section, similar to FIG. 1, but with the output shaft rotating counterclockwise when viewed from the right.

Referring now to FIG. 4, there is illustrated the motor of FIG. 1, but with the output shaft rotating in the counterclockwise direction. As is well known in the art, in order to achieve counterclockwise shaft rotation, pressurized fluid is communicated to the fluid port 23. From the port 23 the main flow path is just the opposite of that described in connection with FIG. 1. As a result, the rotor 27 now orbits in the clockwise direction and rotates in the counterclockwise direction. This movement of the rotor 27 is transmitted by the drive shaft 61 into counterclockwise rotation of the output shaft assembly 45. Fluid exhausted from the contracting volume chambers is communicated through the passages 39 and slots 41, then through the feed slots 75 into the annular groove 71. Low pressure exhaust fluid flows from the groove 71 out the fluid port 21 to the system reservoir.

With the fluid port 23 receiving pressurized fluid, and the main flow path being reversed as described above, lubrication fluid flows along the end faces of the rotor 27 into the chamber 59 in the same manner as described in connection with FIG. 1. However, because the annular groove 73, rather than the groove 71, is now pressurized the other source of lubrication is fluid which leaks from the groove 73 and flows though the clearance between the spool bore 33 and spool valve 49, to the left in FIG. 4. This lubrication fluid then flows radially inwardly through the clearance between the left end of the spool valve 49 and the adjacent surface of the port plate 15 and enters the lubrication fluid chamber 59. With the annular groove 73 pressurized, the check valve assembly 93 is held in the closed position, and with the annular groove 71 in communication with the reservoir, the check valve assembly 91 is able to open, permitting relatively unrestricted flow of lubrication fluid from the chamber 59 into the annular groove 71. As a result of the location of the check valve assembly 91, lubrication fluid entering the chamber 59 from between the rotor 27 and end cap 17 flows through the splines 65 and 69, then combines with the lubrication fluid from between the rotor 27 and port plate 15 as well as that from between the spool valve 49 and port plate 15. This lubrication fluid flows to the right in FIG. 4, passing through the splines 63 and 67, then through the check valve assembly 91 and out to the reservoir without having to pass through any restrictions or clearances which are sufficiently small to trap contamination particles.

Referring now primarily to FIGS. 5, 6, and 7, a preferred embodiment of the check valve assembly 91 will be described in greater detail. The spool valve 49 defines a relatively smaller radial bore 101 and a relatively larger radial bore 103 which define an annular valve seat 105. Loosely seated against the valve seat 105 is a check ball 107 which, as described previously, is held in sealing engagement with the valve seat 105 when the annular groove 71 is in communication with pressurized fluid.

The check valve assembly 91 also includes a clip member 109, the primary function of which is to restrain the check ball 107 and limit its movement in a radially outward direction. The clip member 109 is preferably made from a flat strip of spring steel and formed into a portion of a circle, somewhat smaller than the diameter of the annular groove 71 such that when the clip member 109 is inserted as shown in FIG. 7, it tightly grips the surface of the annular groove 71. As may best be seen in FIG. 6, the clip member 109 includes a pair of tab portions 111 and 113 which include bent grip portions 115 and 117, respectively. As is shown in FIG. 7, with the clip member 109 inserted in the annular groove 71, the grip portions 115 and 117 engage opposed side walls of the axial slots 75, thus preventing circumferential and/or radial movement of the clip member 109 relative to the spool valve 49.

The clip member 109 defines a raised portion 119, the size of which is greater than the diameter of the check ball 107. Prevention of circumferential movement of the clip member 109 by means of the grip portions 115 and 117 is partially to insure that the raised portion 119 remains circumferentially aligned with the radial bores 101 and 103, such that fluid flowing through the bores 101 and 103 is able to flow past the portion 119 into the annular groove 71. The raised portion 119 should be configured such that even with the check ball 107 in engagement therewith (dotted line in FIG. 5), the flow area past the check ball 107 is at least as great as the area of the radial bore 101 to permit relatively unrestricted flow of lubrication fluid from the chamber 59 into the annular groove 71.

Figure 8:
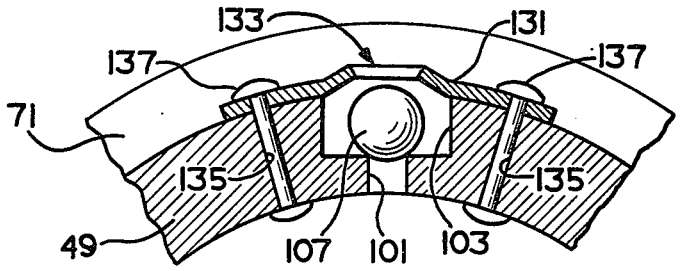
FIG. 8 is a fragmentary, transverse cross section similar to FIG. 7, but on a larger scale illustrating an alternative embodiment of the clip member used in the present invention.
Figure 9:
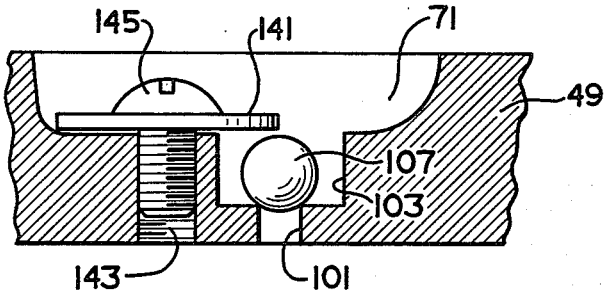
FIG. 9 is an enlarged, fragmentary view, similar to FIG. 5, illustrating another alternative embodiment of the invention.
Figure 10:
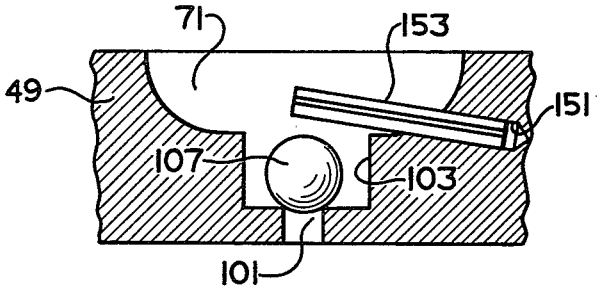
FIG. 10 is an enlarged, fragmentary view, similar to FIGS. 5 and 9, illustrating still another alternative embodiment of the invention.

Referring now to FIGS. 8–10, there will be described several alternative embodiments of the means for restraining movement of the check ball 107. In FIG. 8, which is a view similar to FIG. 7, the check ball 107 is restrained by means of a short clip member 131 which defines an open portion 133. Preferably, the open portion 133 is elongated, either axially or circumferentially, to provide sufficient open area through which lubrication fluid can flow, even when the check ball is lifted up, into engagement with the clip member 131. In the embodiment of FIG. 8, a pair of radially-oriented holes 135 are drilled through the valve spool 49, and the clip member 131 is fixedly attached to the bottom surface of the annular groove 71 by means of a pair of rivets 137.

Referring now to FIG. 9, the means for restraining the check ball 107 comprises a generally annular washer member 141 which extends axially over the bore 103 a sufficient distance to prevent the check ball 107 from moving out of the bore 103. Adjacent the bore 103 the spool valve 49 defines a threaded bore 143, and in threaded engagement therewith is a machine screw 145 which holds the washer member 141 in place against the bottom surface of the annular groove 71.

Referring finally to FIG. 10, an angled hole 151 is drilled in the spool valve 49, beginning in the corner of the annular groove 71. A conventional roll pin 153 is inserted into the hole 151 and extends axially over the bore 103 a sufficient distance to keep the check ball 107 within the bore 103.

It is apparent from the above specification and drawings that the present invention provides a lubrication circuit for a motor of the type disclosed herein which insures good flow through both of the spline connections. In addition, the invention insures that contamination particles are removed from the spline connections by the lubrication flow just before the flow leaves the lubrication fluid chamber. The contamination particles are removed through a flow path which is relatively unrestricted, and does not include small clearances which can cause the contamination particles to collect, rather than being removed and eventually filtered. Finally, the invention provides a lubrication circuit which includes just enough restriction to lubrication flow to insure proper lubrication flow rates.

It is believed that various alterations and modifications of the present invention will become apparent to those skilled in the art from a reading and understanding of the present specification. It is intended that all such alterations and modifications are included in the present invention, insofar as they come within the scope of the appended claims.

What is claimed is:

1. In a rotary fluid pressure device of the type including housing means defining a first fluid port, a second fluid port, and a valve bore; a gear set associated with said housing means including an internally-toothed member and an externally-toothed member eccentrically disposed within said internally-toothed member for relative movement therebetween, the teeth of said members interengaging to define expanding and contracting volume chambers during said relative movement; output shaft means extending from said housing means and rotatably supported thereby; a valve spool rotatably disposed within said valve bore and operatively associated with said output shaft means to rotate in synchronism therewith; drive shaft means operable to transmit movement of said externally-toothed member into rotational movement of one of said output shaft means and said valve spool, said drive shaft means cooperating with said externally-toothed member to define a rearward connection means and cooperating with said one of said output shaft means and said valve spool to define a forward connection means; said valve spool defining first and second axially-spaced annular grooves on the outer periphery thereof in fluid communication with said first and second fluid ports, respectively, said first annular groove being disposed adjacent said forward connection means and said second annular groove being disposed intermediate said forward and rearward connection means; and said housing means and said valve spool cooperating to define passage means communicating between said first annular groove and one of said expanding and contracting volume chambers, and between said second annular groove and the other of said expanding and contracting volume chambers; said housing means, said valve spool and said externally-toothed member cooperating to define a lubrication fluid chamber permitting relatively unrestricted flow therethrough; the improvement comprising:

lubrication circuit means for said forward and rearward connection means including:

(a) first check valve means disposed to permit fluid communication from said lubrication fluid chamber to said first annular groove when said second fluid port receives pressurized fluid, lubrication fluid from said gear set flowing through said rearward connection means, combining with lubrication fluid from said second annular groove, and flowing through said forward connection means to said first check valve means; and (b) second check valve means disposed to permit fluid communication from said lubrication fluid chamber to said second annular groove when said first fluid port receives pressurized fluid, lubrication fluid from said gear set flowing through said rearward connection means to said second check valve means, and lubrication fluid from said first annular groove flowing through said forward connection means to said second check valve means.

2. The improvement as claimed in claim 1 wherein said valve spool and said output shaft means are integral and define a forward set of straight internal splines and said drive shaft means defines a forward set of crowned, external splines in engagement with said forward internal splines, said forward internal and external splines comprising said forward connection means.

3. The improvement as claimed in claim 1 or 2 wherein said externally-toothed member defines a rearward set of straight, internal splines and said drive shaft means defines a rearward set of crowned, external splines in engagement with said rearward internal splines, said rearward internal and external splines comprising said rearward connection means.

4. The improvement as claimed in claim 1 wherein said housing means includes a forward sealing means disposed about said output shaft means, said valve spool and said output shaft means cooperating to define forward lubrication passage means operable to communicate lubrication fluid, flowing from said first annular groove to said forward sealing means, to said lubrication fluid chamber, adjacent said forward connection means.

5. The improvement as claimed in claim 1 wherein each of said first and second check valve means includes a check valve member and means disposed radially outwardly of said check valve member to limit radially outward movement thereof.

6. The improvement as claimed in claim 5 wherein said limiting means comprises a clip member adapted to be disposed within said annular groove and to grippingly engage said valve spool around a major portion of the circumference thereof.

7. The improvement as claimed in claim 6 wherein said clip member is configured to limit radially outward movement of said check valve member while permitting relatively unrestricted flow of lubrication fluid past said check valve member.

8. In a rotary fluid pressure device of the type including housing means defining an inlet port, an outlet port, and a valve bore; a gear set associated with said housing means including an internally-toothed member and an externally-toothed member eccentrically disposed within said internally-toothed member for relative movement therebetween, the teeth of said members interengaging to define expanding and contracting volume chambers during said relative movement; output shaft means extending from said housing means and rotatably supported thereby; a valve spool rotatably disposed within said valve bore and operatively associated with said output shaft means to rotate in synchronism therewith; shaft means operable to transmit movement of one of said toothed members into rotational movement of one of said output shaft means and said valve spool; said valve spool defining first and second axially-spaced annular grooves on the outer periphery thereof and said housing means defining first passage means communicating between said inlet port and said first annular groove and second passage means communicating between said second annular groove and said outlet port; and said housing means and said valve spool cooperating to define third passage means communicating between said first annular groove and the expanding volume chambers, and fourth passage means communicating between the contracting volume chambers and said second annular groove; the improvement comprising:

(a) said valve spool defining a lubrication fluid chamber therein permitting relatively unrestricted flow of lubrication fluid therethrough;

(b) first and second check valve means disposed to permit fluid communication from said lubrication fluid chamber to said first and second annular grooves, respectively; and (c) first and second means disposed in said first and second annular grooves, respectively, for limiting movement of said first and second check valve means, respectively, in a radially outward direction.

* * * * *